US005586424A

United States Patent [19]

Chen et al.

[11] Patent Number: 5,586,424

[45] Date of Patent: Dec. 24, 1996

[54] APPARATUS FOR MOVEMENT OF U-SHAPED CLIPS ALONG A RAIL

[75] Inventors: Kuo-Raid G. Chen, Cary; Raymond H. Misner, Raleigh; Elbert P. Windham, Fuquay-Varina; Bernard D. Richardson, Apex, all of N.C.

[73] Assignee: Delaware Capital Formation, Inc., Wilmington, Del.

[21] Appl. No.: 480,524

[22] Filed: Jun. 7, 1995

Related U.S. Application Data

[63] Continuation of Ser. No. 188,020, Jan. 28, 1994, abandoned, which is a continuation of Ser. No. 883,648, May 15, 1992, abandoned.

[51] Int. Cl.[6] ..... B65B 51/04

[52] U.S. Cl. ..... 53/138.2; 53/138.4; 29/243.57

[58] Field of Search ..... 227/120, 134, 227/135, 136; 53/138.2, 138.3, 138.4; 29/243.56, 243.57

[56] References Cited

U.S. PATENT DOCUMENTS

| | | | |
|---|---|---|---|
| 3,174,672 | 3/1965 | Juilfs . | |
| 3,563,438 | 2/1971 | Doyle et al. . | |
| 3,777,400 | 12/1973 | Klenz et al. . | |
| 3,783,583 | 1/1974 | Dobbert . | |
| 3,795,085 | 3/1974 | Andre et al. . | |
| 3,854,648 | 12/1974 | Inzoli et al. | 227/136 |
| 4,001,926 | 1/1977 | Velarde . | |
| 4,004,339 | 1/1977 | Velarde . | |
| 4,109,363 | 8/1978 | Velarde . | |
| 4,424,929 | 1/1984 | Weis . | |
| 4,428,176 | 1/1984 | Burrell . | |
| 4,675,945 | 6/1987 | Evans et al. . | |
| 4,766,713 | 8/1988 | Evans . | |
| 4,821,485 | 4/1989 | Evans et al. . | |
| 5,020,298 | 6/1991 | Evans et al. . | |
| 5,077,955 | 1/1992 | Evans . | |

FOREIGN PATENT DOCUMENTS

| | | |
|---|---|---|
| 33 33 875.2 | 3/1985 | Germany . |

*Primary Examiner*—Rinaldi I. Rada
*Assistant Examiner*—Allan M. Schrock
*Attorney, Agent, or Firm*—Banner & Witcoff, Ltd.

[57] ABSTRACT

A clip feed or advance mechanism for advancing clips on a guide rail into the window of a clip attachment apparatus includes an arm which supports biased jaw members into engagement with the clips. The arm is reciprocally driven by a piston and cylinder arrangement.

2 Claims, 1 Drawing Sheet

APPARATUS FOR MOVEMENT OF U-SHAPED CLIPS ALONG A RAIL

This application is a continuation of application Ser. No. 08/188,020, filed Jan. 28, 1994 now abandoned which is a continuation of application Ser. No. 07/883,648 filed on May 15, 1992 now abandoned.

BACKGROUND OF THE INVENTION

This invention relates to apparatus for advancing or moving U-shaped metal clips on a guide rail into a clip attachment apparatus.

The use of U-shaped metal clips for closure of packages by attachment about gathered packaging material is disclosed in prior patents, for example, U.S. Pat. No. 4,766,713 which is incorporated herewith by reference. Typically, the U-shaped metal clips are supported on a guide rail which receives and supports a plurality of the clips and directs or guides them, one at a time, into a window of a clip channel. Each clip positioned in the channel is then driven by a punch about gathered material and against a die to thereby close or wrap the clip about the gathered material. Each clip is fed into the window by means of gravity, alone or assisted by means of a weight which is placed on the clips to facilitate gravity feeding. Alternatively, a friction wheel is engaged against the sides of the clips to force them into the window of the clip attachment apparatus.

The described clip advancement mechanisms have been successful and useful. However, when long coils of clips are to be fed along a rail and into a clipper, the use of gravity feed or a weight on top of the clips becomes an impractical method for feeding of the clips. Use of friction wheels, while generally satisfactory, does not necessarily provide the positive clip feeding action required. Thus, there is the a need to provide an improved clip advance mechanism.

SUMMARY OF THE INVENTION

Briefly, the present invention comprises an improvement in apparatus for attaching a U-shaped metal clip about gathered material. The clip attachment apparatus is of the type which comprises a housing with a clip channel for receipt of a U-shaped clip. A punch is positioned for driving a clip through the channel and about gathered material. A window is provided for access to the channel for feeding single clips into the channel prior to advancement of the clip through the channel by the punch. A guide rail is positioned to support a plurality of stacked clips so that they may be fed one at a time through the window and into the channel.

The improvement of the present invention comprises clip feed means for positively advancing the clips on the guide rail into the window. The improved clip feed means includes an arm which is supported in opposed relation to stacked clips positioned on the guide rail. A jaw member is pivotally mounted on the arm for pivotal movement about an axis so that an end of the jaw member is movable toward and away from the stacked clips. The end of the jaw member which is biased toward the clips includes a special tooth construction which engages one or more clips as the jaw member is biased into contact with the clips. A rod is connected to the arm for driving the arm generally parallel with the guide rail, and means are provided to drive the rod to thereby advance or provide a force to advance the clips on the rail. The means for driving the rod is reversible so that the clip driving arrangement can effectively reset itself periodically. Thus, the driving means is reciprocal and effectively drives the clips along the rail in a first direction and then reverses itself for resetting in the opposite direction.

Thus it is an object of the invention to provide an improved clip advance mechanism.

It is a further object of the invention to provide an improved clip advance mechanism having a minimum number of parts and having a simplified construction.

Yet another object of the invention is to provide an improved clip advance mechanism which is designed to incrementally advance a stack of clips, one at a time, into a clip attachment apparatus.

A further object of the invention is to provide an improved clip advance mechanism which includes means for manually disengaging the advance mechanism from a stack of clips mounted on a guide rail.

These and other objects, advantages and features of the invention will be set forth in the detailed description which follows.

BRIEF DESCRIPTION OF THE DRAWING

In the detailed description which follows reference will be made to the drawing comprised of the following figures.

DESCRIPTION OF THE PREFERRED EMBODIMENT

Figure 1:
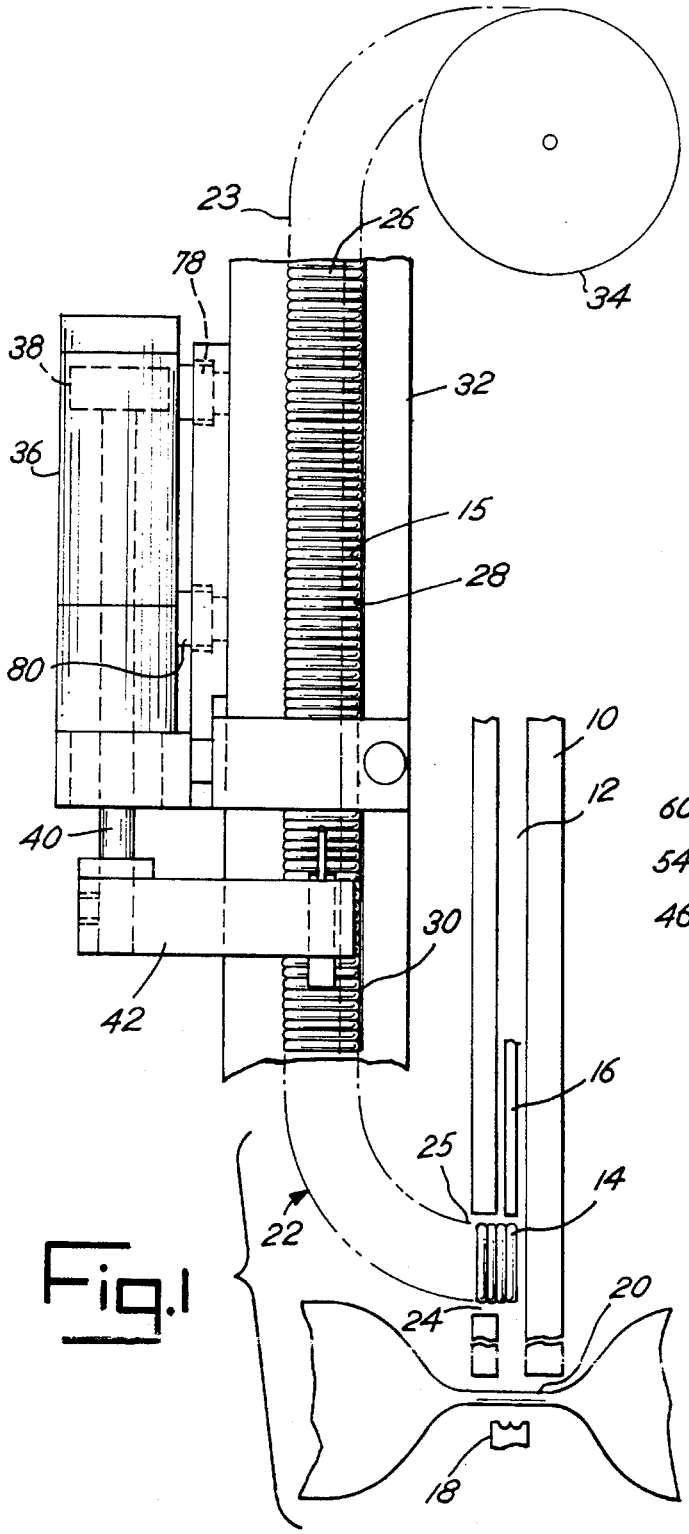
FIG. 1 is a side elevation of the improved apparatus of the invention.

Referring to the Figures, the improvement of the invention is incorporated in a clip attachment apparatus or clipper. Typically, the clip attachment apparatus includes a housing 10 which defines a channel 12 for receipt of a U-shaped metal clip 14. The clip 14 is advanced in the channel 12 by means of a punch 16 so that the clip 14 will engage a die 18 positioned in a manner permitting the clip 14 to be formed about gathered material 20.

Each clip 14 is typically fed from a guide rail 22 through a window 24 into the channel 12. Most typically, guide rail 22 has a vertical run 23 which is curved at its lower end so that it gradually forms a horizontal run 25 to direct clips 14 mounted thereon into the window 24. The clips 14 are typically arranged in a stack 15 with the clips 14 overlying one another so that the legs 26 of each clip 14 fit around the guide rail 22 and encircle the guide rail 22 with a crown 28 of each clip 14 fitting over the guide rail 22. Typically, the multiple clips 14 are connected to one another by means of a thin tape or adhesive 30 along the crown 28 so that the clips 14 may slide down the guide rail 22 and around the bend therein between the vertical and horizontal runs 23, 25 of the guide rail. Typically, clips 14 are provided in a coil or on a reel 34 for feeding onto the guide rail 22. Reel 34 is schematically depicted in the Figures for feeding of the clips 14 onto the guide rail 22. A retention rail 32 is arranged in opposed and spaced relation to the guide ran 22. The retention rail 32 is thus spaced a distance slightly greater than the thickness of the crown 28 to prevent the clips 14 from falling off the guide rail 22.

The clip advancement mechanism is mounted on the guide rail 22 on the side of the guide rail 22 opposite the crown 28 for the clips 14. The clip advance mechanism includes a cylinder 36 which may be hydraulic or air-driven.

Cylinder 36 is mounted by means of supports or brackets 78 and 80 attached to the guide rail 22. The cylinder 36 has an axis which is generally parallel to the length of the horizontal run 23 of the guide rail 22. The cylinder 36 includes an internal piston 38 which may be actuated to move in the vertical direction parallel to the guide rail 22 in response to pressure within the cylinder 36. The piston 38 is connected to a rod 40 at the lower end of the cylinder 36. The rod 40 connects to an arm 42 which has a U-shape so that the arm includes parallel horizontal rum 44 and 46 that extend on opposite sides of the guide rail 22. Each run 44 and 46 separately supports a jaw 48 and 50, respectively. The jaw 48 is pivotally mounted in the run 44 by means of a pin 52. Pin 54 pivotally mounts the jaw 50.

Figure 2:
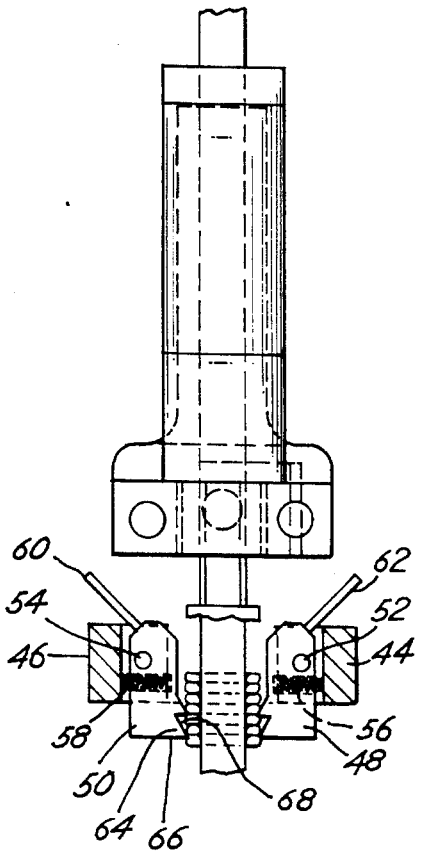
FIG. 2 is an end view of the improved apparatus of the invention and view.
Figure 3:
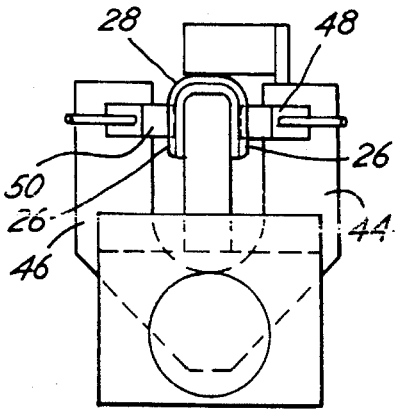
FIG. 3 is a top plan view of the improved apparatus of the invention view.

A biasing spring 56 interposed between the jaw 48 and run 44 comprises a coil spring which fits in compatible openings in the jaw 48 and run 44. Spring 56 biases the jaw 48 in a counterclockwise direction in FIG. 2 about pin 52 toward engagement with clips 14 and, more particularly, into engagement with legs 26 of clips 14. In a similar fashion, spring 58 biases the jaw 50 about pin 54 into engagement with the opposite legs 26 of the clips 14.

Manual levers, 60 for jaw 50 and 62 for jaw 48, extend from the jaws 50 and 48, respectively. The manual levee 60, 62 may be actuated manually against the force of the springs 56 and 58 to spread the jaws 48 and 50 and disengage them from the clips 14.

Each jaw 48, 50 has a special construction of teeth for engagement with the legs 26. Thus, each jaw 48, 50 includes at least one tooth 64 which includes a surface 66 generally at a right angle to the guide rail 22 and a surface 68 generally forming an acute angle with the rail 22. In this manner, a tooth 64 is formed which is pointed in the direction of clip travel along the guide 22. The surface 68 insures that when the arm 42 is moved in the upward direction opposite the desired direction of driving of the clips 14, the surface 68 will slide over the clips 14 and will not move the clips 14 upwardly along the guide rail 22. However, when the rod 40 is driven by activation of the piston 38 the teeth, such as tooth 64, will engage against the sides of the legs 26 to drive the stack of clips 14 downwardly on the guide rail 22.

The cylinder 36 is a double-acting cylinder. Hydraulic or fluid pressure is typically provided against the top surface of the piston 38 to provide a constant and controlled pressure driving force for the arm 42. When the piston 38 reaches the lower end of its run within the cylinder 36, the fluid driving forces are reversed so that the piston 38 can quickly return to its initial driving position at the top of the cylinder 36.

The construction of the teeth 64 previously set forth enables the jaws 48 and 50 to easily slide over the surface of the clips 14 during the reverse or upward movement of the piston 38, rod 40, arm 42 and attached component parts. Additionally, the manual levers 60 and 62 may be actuated to facilitate disengagement of the jaws 48 and 50 from the clips 14.

It is possible to vary the construction of the invention without departing from the spirit and scope of the invention- For example, there has been described a construction with a pair of jaws 48 and 50. A single jaw may be utilized. The construction of the jaws and arrangement of the jaws may also be varied. The mechanism for driving the arm 42 in a reversible direction may be varied. The invention is therefore limited only by the following claims and their equivalents.

What is claimed is:

1. In apparatus for attaching a U-shaped metal clip of the type having a pair of spaced parallel legs connected at respective ends by a crown about gathered material, said apparatus including a housing having at least one clip channel for receipt of at least one U-shaped clip, at least one punch for driving a clip present in the channel about gathered material, a window for feeding at least one clip into said one channel into the pathway of said punch, at least one guide rail for supporting a plurality of aligned clips for feeding one at a time through said window into said channel in the pathway of said punch, said guide rail having an inside surface opposite side surfaces and an outside surface, the improvement comprising:

clip feed means for advancing the clips on said guide rail and into said window, said clip feed means comprising, in combination:

(a) a U-shaped arm which is supported in opposed relation to and over a series of stacked clips on the guide rail, said clips each having the clip legs extending on the opposite side surfaces of the rail and said clips further each having the crown connecting said clip legs on the inside surface, said clips aligned side by side and stacked and connected to one another along the crowns, said arm including parallel first and second runs extending on the opposite sides of the rail in opposed relation to said first and second clip legs respectively, said arm further including an arm connection section connecting said first and second runs, said arm section being positioned on the outside of the guide rail;

(b) first and second jaw members pivotally mounted on said first and second runs of the arm respectively, each one of the jaw members extending over a clip leg and positioned for pivotal movement about a pivot axis to and from positions in which an end of each jaw member is pressed against the side of and thereby engaged against a leg of the stacked, connected clips on each side of the rail respectively;

(c) biasing means for biasing each jaw member about its pivot axis into said position of engagement with a clip leg;

(d) a support rod connected to the arm at the arm connection section for driving the legs generally parallel in the direction of the guide rail;

(e) means for driving the rod in a first direction with each of the jaw members engaged with a clip leg of the same clip to thereby advance the clips on the guide rail into the window, said means fox driving operable in the opposite direction for positioning of the arm and jaw members by sliding the jaw members over clip legs to thereby position the jaw members for driving of additional clips, each of said jaw members including at least one clip engaging tooth shaped for maintaining both of the jaw members in driving contact with the same clip legs in the first direction and for release of driving contact of the clips legs when moved in the opposite direction, said tooth including a first surface generally at a right angle to the rail and a second surface at an acute angle with respect to the rail to form a tooth pointed in the direction of clip travel; and (f) a clip retention rail spaced from and generally parallel to the guide rail along the length of the inside surface, said clip retention rail positioned with the crowns of the clips between the guide rail and retention rail hereby the crowns are positioned slidably between the guide rail and retention rail;

said clip feed means defining means for feeding of stacked, connected clips by pressure against and engagement of the clip engaging teeth against the sides of the clip legs of one of the stacked, connected clips located adjacent the clip feed means with the clips retained on the guide rail by the retention rail as the jaws drive the clips when the arm moves in the first direction, but not the opposite direction.

2. The improvement of claim 1 including a manual lever projecting from each jaw for engagement to permit manual movement of each jaw against the force of the associated biasing means to thereby disengage each jaw from the associated clip legs.

* * * * *